United States Patent [19]

Yoshitomi et al.

[11] Patent Number: 4,888,066

[45] Date of Patent: Dec. 19, 1989

[54] METHOD FOR PRODUCING GRAIN-ORIENTED ELECTRICAL STEEL SHEET WITH VERY HIGH MAGNETIC FLUX DENSITY

[75] Inventors: Yasunari Yoshitomi; Kenzo Iwayama; Takeo Nagashima; Kenichi Yakashiro, all of Kitakyushu, Japan

[73] Assignee: Nippon Steel Corporation, Tokyo, Japan

[21] Appl. No.: 245,828

[22] Filed: Sep. 16, 1988

[30] Foreign Application Priority Data

Sep. 18, 1987 [JP] Japan ..... 62-232356

[51] Int. Cl.[4] ..... H01F 1/04

[52] U.S. Cl. ..... 148/113; 148/111

[58] Field of Search ..... 148/111, 112, 113

[56] References Cited

U.S. PATENT DOCUMENTS 4,225,366 9/1980 Harase et al. ..... 148/111

FOREIGN PATENT DOCUMENTS 54-40227 3/1979 Japan ..... 148/113
56-33450 8/1981 Japan .
62-222024 9/1987 Japan .
62-270724 11/1987 Japan ..... 148/113

*Primary Examiner*—John P. Sheehan
*Attorney, Agent, or Firm*—Kenyon & Kenyon

[57] ABSTRACT

A method of producing grain-oriented electrical steel sheet with a very high magnetic flux density, is characterized by increasing the partial pressure of the $N_2$ in the annealing atmosphere at the intermediate stage between the start and the finish of the secondary recrystallization, and by ensuring the temperature differential in the coil does not exceed 100° C. during changes to the annealing atmosphere. In addition, the rate of temperature increase at the hottest part of the coil is kept to a maximum of 13° C./hr at least part of the time the coolest part of the coil is between 850° C. and 1100° C.

5 Claims, 2 Drawing Sheets

METHOD FOR PRODUCING GRAIN-ORIENTED ELECTRICAL STEEL SHEET WITH VERY HIGH MAGNETIC FLUX DENSITY

BACKGROUND OF THE INVENTION

1. Field of the Invention

The present invention relates to a method for producing high-magnetic-flux-density grain-oriented electrical steel sheet such as is used for the cores of transformers.

2. Description of the Prior Art

Grain-oriented electrical steel sheet is a mildly magnetic material used in various items of electrical equipment, such as, for example, transformers. For this, it is required that such materials exhibit good magnetic properties; specifically, excitation properties and a low watt loss.

Generally $B_8$ is used to represent excitation properties numerically, the said $B_8$ being the magnetic flux density at a field strength of 800A/m. Watt loss is generally indicated as $W_{17/50}$, which is the watt loss per kilogram of material magnetised to 1.7 T at 50 Hz.

The grain-oriented electrical steel sheet is obtained by producing secondary recrystallization during the final-annealing process thereby to achieve a so-called Goss orientation, i.e., {110} plane <001> axis. To obtain good magnetic properties, it is important that the axis of easy magnetization, i.e., <001>, be aligned to a high degree with the rolling orientation of the sheet. The thickness of the sheet, grain diameter, specific resistance, surface film and the degree of purity of the sheet also have a major bearing on magnetic properties.

Orientation was improved considerably by a process characterized by the use of final high-reduction cold-rolling utilizing MnS or AlN as inhibitors, and by the accompanying marked improvement in core loss.

With the sharp increases in energy prices of recent years, transformer manufacturers have re-doubled their efforts to find materials from which they could construct low-core-loss transformers. Amorphous alloys and 6.5% silicon steel are among materials which are being developed for low-loss cores. However, these materials still have problems which need to be solved if the materials are to be used for transformers on an industrial basis.

Recent years have also seen the development of magnetic domain control techniques utilizing lasers, and these techniques have resulted in dramatic improvements in core-loss properties. Furthermore, the higher the magnetic flux density of the product is, the greater the effectiveness of the magnetic domain control techniques, which has increased the necessity of developing products with very high magnetic flux densities.

Japanese published unexamined patent application No. 62(1987)-222024 proposed a method for raising the magnetic flux density during the production of grain-oriented electrical steel sheet containing Al. This method comprised increasing the $N_2$ partial pressure of the annealing atmosphere at an intermediate stage between the start and finish of secondary recrystallization. However, stable production of heavy coils weighing from five to twenty tons is difficult.

Another method for raising the magnetic flux density during the production of grain-oriented electrical steel sheet containing Al was proposed in Japanese published examined patent application No. 56(1981)-33450 which comprised lowering the rate at which the temperature is increased during final finish-annealing. However, owing to instabilities in secondary recrystallization with this method, there are still problems to be solved before it can be applied industrially.

SUMMARY OF THE INVENTION

The object of the present invention is to provide a method of stably manufacturing heavy coils of grain-oriented electrical steel sheet having a very high magnetic flux density.

DETAILED DESCRIPTION OF THE INVENTION

Figure 1:
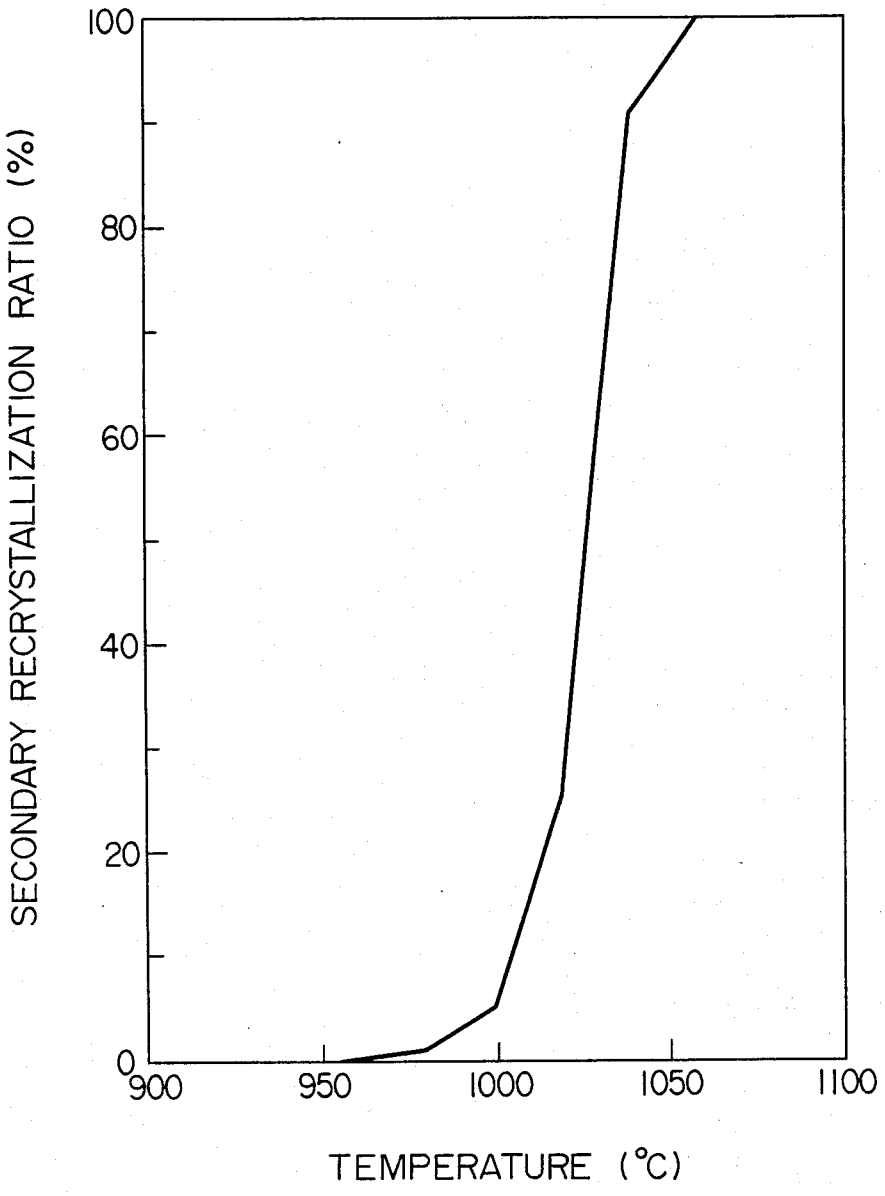
FIG. 1 is a graph illustrating the relationship between temperature and secondary recrystallization behavior.

The Al-containing grain-oriented electrical steel sheet that is the object of this invention is produced by the ingot method or by continuous casting of molten steel obtained by a conventional method, and if required this is preceded and followed by an ingot process to form slabs. This is followed by hot-rolling and, if necessary, by sheet annealing, and then by one cold-rolling or two or more cold-rollings separated by intermediate annealings to obtain cold-rolled sheet of the final gauge. Decarburization annealing is then carried out using a conventional method.

The hot-rolled sheet contains from 2.5 to 4.0% by weight of silicon, from 0.03 to 0.10% by weight of carbon, from 0.010 to 0.065% by weight of acid-soluble aluminum, from 0.0010 to 0.0150% by weight of nitrogen, from 0.02 to 0.30% by weight of manganese and from 0.005 to 0.040% by weight of sulfur, with the remainder being iron and unavoidable impurities.

A silicon content exceeding 4.0% is undesirable because it produces marked embrittlement, making cold-rolling difficult. On the other hand, when there is less than 2.5% silicon, the electrical resistance is low and it is difficult to obtain good core loss properties. With less than 0.03% carbon the amount prior to the decarburization process becomes extremely small making it difficult to obtain a good primary recrystallization structure. On the other hand, the carbon should not exceed 0.10%, as it will result in imperfect decarburization.

Acid-soluble aluminum and nitrogen are fundamental components of the principal inhibitor AlN which is essential for obtaining high magnetic flux density in the present invention. The content of these components should be within the above-mentioned limits of 0.010 to 0.065% acid-soluble aluminum and 0.0010 to 0.0150% nitrogen to prevent instability in the secondary recrystallization.

The elements Mn and S are required as inhibitors. The amount of Mn should be in the range of 0.02 to 0.30%, and S should be kept to 0.005 to 0.040%. If the above ranges are deviated from, the secondary recrystallization is unstable.

Elements other than the above that are known inhibitor components which may be used, include tin, antimony, selenium, tellurium, copper, niobium, chromium, nickel, boron, vanadium, arsenic and bismuth. The upper limit for nickel and vanadium is 1.0%, for tin, antimony, copper and chromium is 0.4%, for bismuth is 0.3%, for arsenic is 0.2%, for niobium is 0.1%, for selenium and tellurium is 0.04% and for bismuth is 0.01% (all by weight).

In the present invention the main inhibitor is AlN. If necessary, annealing to precipitate the AlN is performed in a process prior to the final cold-rolling. Following decarburization annealing, the sheet is coated with an annealing separating agent having MgO as its main component, and final finish-annealing is performed. The feature of the present invention lies in this final finish-annealing process.

Generally, the final finish-annealing is carried out on steel sheet formed into coils weighing 5 to 20 tons (hereinafter "large coils"), and within the coils there is an unavoidable non-uniformity of temperature. In this invention, "lowest temperature site" refers to the portion of the strip forming the coil where the temperature is lowest, and "highest temperature site" refers to the portion having the highest temperature.

The problem of non-uniformity of the coil temperature had to be solved if sheet having a very high magnetic flux density were to be produced stably on a commercial basis.

The inventors discovered that uniform heating of the coil was required to solve the problems of the narrow limits of the effective region in the coil in increasing of the $N_2$ partial pressure in the annealing atmosphere.

Various experiments were carried out to find an effective method, and it was discovered that it was highly effective for the rate of temperature increase at the highest temperature site of the coil not to exceed 13° C./hr at least temporarily during the time the lowest temperature site of the coil was at a temperature of from 850° C. to 1100° C.

FIG. 1 shows an example of the relationship between temperature and the secondary recrystallization process. In the case of the material of FIG. 1, the starting material was hot-rolled sheet 2.3 mm thick containing 3.23% silicon, 0.078% carbon, 0.026% acid-soluble aluminum, 0.008% nitrogen, 0.074% manganese and 0.025% sulfur. The hot-rolled sheet was annealed for two minutes at 1100° C., quenched, then cold-rolled to a final thickness of 0.225 mm and was then subjected to decarburization annealing by a known method, and then coated with an annealing separating agent, which had as its main component MgO, to obtain samples.

The samples were then heated to 1100° C. at a temperature increase rate of 10° C./hr in a gas mixture consisting of 75 percent $H_2$ and 25 percent $N_2$. In the temperature range 900° C. to 1100° C., samples were removed from the furnace at each rise in temperature of 20° C. These samples were pickled and the percentage of the surface accounted for by secondary recrystallization grains (secondary recrystallization ratio) was measured. As can be seen from FIG. 1, the range of temperatures at which secondary recrystallization occurs is from 960° C. to 1060° C., a temperature spread of 100° C.

The present inventors investigated the secondary recrystallization process when the composition and process are varied, and found that while the secondary recrystallization starting and finishing temperatures were somewhat dependent on composition and process conditions, the temperature spread at which secondary recrystallization occurs is in the order of 100° C., as shown by FIG. 1.

Figure 2:
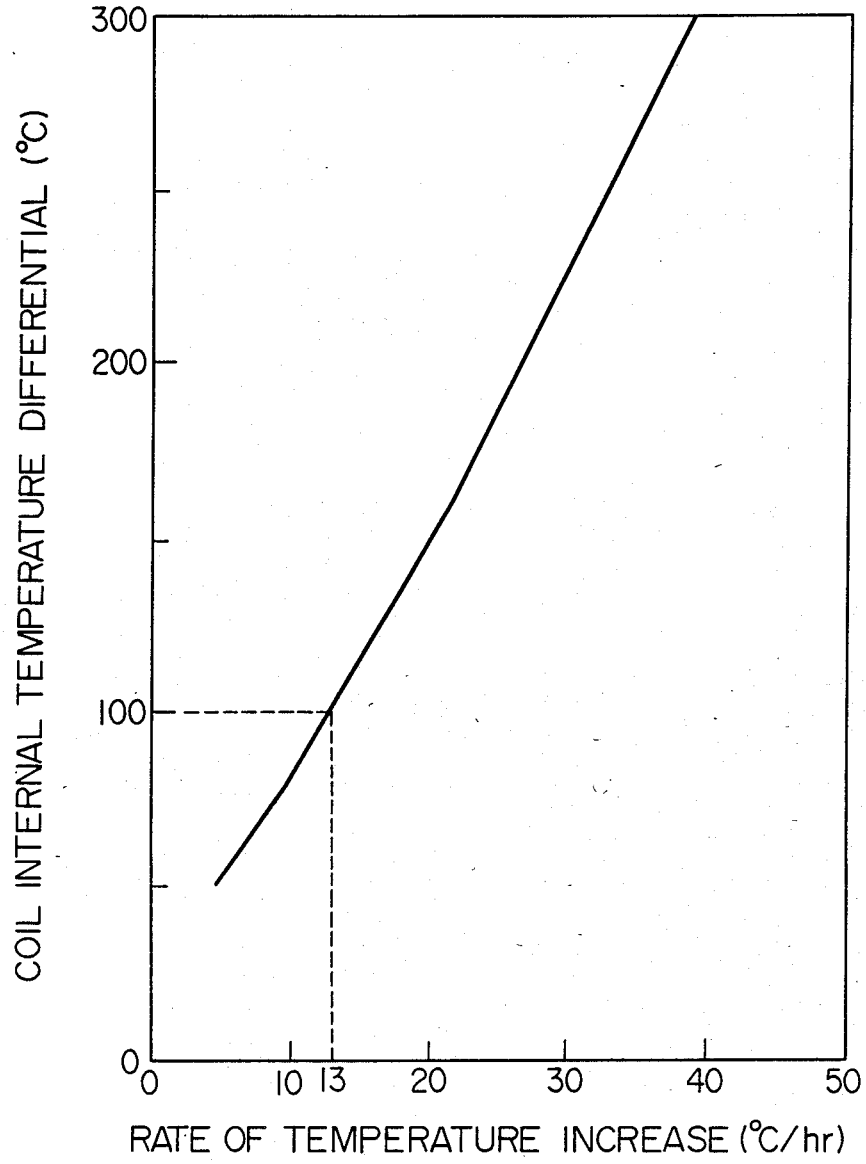
FIG. 2 is a graph illustrating the relationship, during final-annealing, between the rate of temperature increase at the highest temperature site and the coil internal temperature differential at a lowest temperature site temperature of 960° C.

FIG. 2 shows an example (computed) of the relationship between the rate of temperature increase at the highest temperature site during final finish-annealing of a 5-ton coil and the temperature differential inside the coil when the lowest temperature site is 960° C. A sheet thickness of 0.225 mm was assumed for the calculation.

From FIG. 2, it can be seen that up to a rate of temperature increase of 13° C./hr, the temperature differential in the coil when the lowest temperature site is 960° C. does not exceed 100° C. In addition, it was confirmed that varying the coil shape and sheet thickness caused virtually no change to the value of 13° C./hr, within the limits of the conditions in general commercial use.

In the present invention, the $N_2$ partial pressure of the annealing atmosphere is increased at an intermediate stage between the start and the completion of secondary recrystallization. This is for aiding the growth of the secondary-recrystallization grains produced in the initial stage of secondary recrystallization which have an orientation that is extremely close to {110}<001> to thereby raise the magnetic flux density of the product; this is done by suppressing the secondary recrystallization of primary recrystallization grains with the orientation away from {110}<001> at an intermediate stage of the secondary recrystallization. It is this that necessitates the formation of an inhibitor (nitride) that has AlN as the main constituent by increasing the partial pressure of the $N_2$ in the annealing atmosphere at a stage mid-way between the start and the completion of secondary recrystallization, and it is also because of this that there is no effect prior to, or following, the secondary recrystallization.

When the annealing atmosphere is being changed the temperature differential in the coil should be kept to within 100° C. The reason for this is that during this change the entire coil is in an intermediate state between the start and completion of secondary recrystallization, and as such it is necessary to keep the temperature differential in the coil to within the secondary recrystallization process temperature spread of 100° C.

The reason will now be explained for specifying a maximum rate of temperature increase at the highest temperature site of 13° C./hr, at least temporarily during the time the lowest temperature site of the coil is at a temperature ranging from 850° C. to 1100° C.

With a lowest temperature site temperature of below 850° C., the rate of temperature increase at the coil's highest temperature site has no major influence on the temperature differential in the coil when the lowest temperature site is at the secondary recrystallization starting temperature (i.e., around 960° C.). On the other hand, when the lowest temperature site exceeds 1100° C., recrystallization within the sheet of the coil is virtually finished, hence it is necessary to control the temperature increase rate to within the lowest temperature site temperature limits of 850° C. to 1100° C.

From FIG. 2, when the temperature of the lowest temperature site reaches 960° C. when the rate of temperature increase at the highest temperature site is not over 13° C./hr, the temperature differential within the coil will be 100° C. or less. Therefore, 13° C./hr is specified for the rate of temperature increase at the highest temperature site of the coil at least temporarily during the time the lowest temperature site is at a temperature of from 850° C. to 1100° C.

With respect to the final finish-annealing, there are no specific limitations on the temperature at which the $N_2$ partial pressure of the annealing atmosphere is increased, or on the timing from the commencement of the annealing, other than that the secondary recrystallization should have started. Preferably the $N_2$ partial pressure should be increased at the initial stage of the start of the secondary recrystallization, as this is more effective. Again, while the degree of the increase in the $N_2$ partial pressure is not especially limited, preferably the increase should be at least 25% for increased effectiveness.

The feature of the present invention resides in combining the effective metallurgical phenomena obtained at an intermediate stage between the start and the finish of secondary recrystallization and control of the temperature of the coil in order to expand the effective region. Instability of the secondary recrystallization caused by lowering the rate of temperature increase can be reduced by raising the $N_2$ partial pressure of the annealing atmosphere at an intermediate stage between the start and finish of secondary recrystallization.

In this invention, it is specified that the temperature differential in the coil when the final finish-annealing atmosphere is being changed shall not exceed 100° C. That is, in carrying out final finishing annealing when employing the technique of the present invention to produce a single coil containing both grain-oriented electrical steel sheet in which AlN is not employed as the inhibitor (hereinafter referred to as sheet in which the phenomenon of the present invention is not readily produced) and grain-oriented steel sheet in which AlN is employed as the principle inhibitor (hereinafter referred to as sheet of the present invention), when changing the annealing atmosphere it is necessary to keep the temperature differential of the portion of the coil consisting of sheet of the present invention to within 100° C.

In this invention, also, as stated above, for final finish-annealing it is stipulated that the rate of temperature increase at the highest temperature site shall not exceed 13° C./hr at least temporarily during the time the lowest temperature site of the coil is at a temperature ranging from 850° C. to 1100° C.

As stated above, when carrying out final finish-annealing of a single coil comprised of sheet of the present invention and sheet in which the phenomenon of the present invention is not readily produced, it is necessary to keep the rate of temperature increase at the highest temperature site of the sheet of the present invention to a maximum of 13° C./hr at least temporarily during the time the lowest temperature site of the sheet of the present invention is at a temperature ranging from 850° C. to 1100° C.

In carrying out final annealing, applying the technique of the present invention to a single coil comprised of sheet of the present invention and sheet in which the phenomenon of the present invention is not readily produced is advantageous, because it enables productive efficiency to be raised by increasing the weight of the coil, and also because it enables the portions consisting of sheet of the present invention to be located at positions having good heating uniformity.

Core loss properties can be improved further by applying a tension coating to the sheet after final finish-annealing. Because the product manufactured in accordance with the process of the present invention has such a high magnetic flux density, magnetic domain control using a laser or suchlike means produces sheet with outstanding core loss properties.

It has been pointed out in the foregoing that with the present invention, it is possible to produce, stably, grain-oriented electrical steel sheet having a very high magnetic flux density by, in the final finish-annealing process, controlling the temperature of the coiled sheet and increasing the $N_2$ partial pressure of the annealing atmosphere at an intermediate stage between the start and finish of secondary recrystallization. As such, industrially the invention is highly effective.

EXAMPLE 1

Hot-rolled sheet 2.3 mm thick containing 3.25% silicon, 0.078% carbon, 0.027% acid-soluble aluminum, 0.0079% nitrogen, 0.075% manganese, 0.025% sulfur and 0.10% tin was annealed for two minutes at 1100° C., cold-rolled to a final thickness of 0.225 mm and subjected to decarburization annealing by a known method. This was followed by the application of an annealing separating agent having MgO as the main ingredient.

Computer simulation was used to obtain the thermal history of the highest and lowest temperature sites in 5-ton coils heated in a batch-type heating furnace, as follows.

(1) To 1200° C. at 25° C./hr and at 1200° C. for 20 hours.

(2) To 1200° C. at 10° C./hr and at 1200° C. for 20 hours.

(3) To 850° C. at 25° C./hr, from 850° C. to 1100° C. at 10° C./hr and from 1100° C. to 1200° C. at 25° C./hr, and at 1200° C. for 20 hours.

Experiments were then conducted using these thermal history conditions.

Atmospheric gas processing conditions were:

(a) 75% $H_2$+25% $N_2$ up to a lowest temperature site temperature of 1100° C.;

(b) 75% $H_2$+25% $N_2$ up to a lowest temperature site temperature of 980° C. and 10% $H_2$+90% $N_2$ from a lowest temperature site temperature of 980° C. to 1100° C.

Using this two-level processing, annealing was carried out at 100% $H_2$ after the lowest temperature site temperature reached 1100° C. from room temperature.

Whichever the set of conditions, secondary recrystallization was at an intermediate stage at 980° C., and under conditions (2) and (3) the rate of temperature increase at the highest temperature site did not exceed 13° C./hr at least temporarily during the time the lowest temperature site was at a temperature of from 850° C. to 1100° C. Table 1 shows the processing conditions used and the magnetic flux density of the product.

TABLE 1

| Conditions | | $B_8$ (T) Lowest temperature site | Highest temperature site | Mean of highest and lowest temperature sites | Temperature differential (°C.) between highest and lowest temperature sites during increase of $N_2$ partial pressure | Notes |
|---|---|---|---|---|---|---|
| (1) | (a) | 1.92 | 1.92 | 1.92 | — | Comparative example |
| | (b) | 1.94 | 1.92 | 1.93 | 188 | Comparative example |

TABLE 1-continued

| Conditions | | $B_8$ (T) Lowest temperature site | Highest temperature site | Mean of highest and lowest temperature sites | Temperature differential (°C.) between highest and lowest temperature sites during increase of $N_2$ partial pressure | Notes |
|---|---|---|---|---|---|---|
| (2) | (a) | 1.93 | 1.92 | 1.925 | — | Comparative example |
| | (b) | 1.95 | 1.93 | 1.94 | 80 | This invention |
| (3) | (a) | 1.92 | 1.93 | 1.925 | — | Comparative example |
| | (b) | 1.95 | 1.94 | 1.945 | 83 | This invention |

EXAMPLE 2

Hot-rolled sheet 2.3 mm thick containing 3.25% silicon, 0.077% carbon, 0.028% acid-soluble aluminum, 0.0079% nitrogen, 0.074% manganese, 0.025% sulfur, 0.13% tin and 0.06% copper was annealed for thirty seconds at 1120° C., maintained for one minute at 900° C., quenched and cold-rolled to a final thickness of 0.225 mm and subjected to decarburization. This was followed by the application of an annealing separating agent having MgO as the main ingredient.

Computer simulation was used to obtain the thermal history of the highest and lowest temperature sites in 5-ton coils heated in a batch-type heating furnace, as follows.

(1) To 1200° C. at 20° C./hr and at 1200° C. for 20 hours.

(2) To 1200° C. at 10° C./hr and at 1200° C. for 20 hours.

(3) To 900° C. at 20° C./hr, from 900° C. to 1100° C. at 5° C./hr and from 1100° C. to 1200° C. at 20° C./hr, and at 1200° C. for 20 hours.

Experiments were then conducted using these thermal history conditions.

Atmospheric gas processing conditions were:

(a) 85% $H_2$+15% $N_2$ up to a lowest temperature site temperature of 1100° C.;

(b) 85% $H_2$+15% $N_2$ up to a lowest temperature site temperature of 970° C. and 25% $H_2$ +75% $N_2$ from a lowest temperature site temperature of 970° C. to 1100° C.

Using this two-level processing, annealing was carried out at 100% $H_2$ after the lowest temperature site temperature reached 1100° C. from room temperature.

Whichever the set of conditions, secondary recrystallization was at an intermediate stage at 970° C., and under conditions (2) and (3) the rate of temperature increase at the highest temperature site did not exceed 13° C./hr at least temporarily during the time the lowest temperature site was at a temperature of from 850° C. to 1100° C. Table 2 shows the processing conditions used and the magnetic flux density of the product.

TABLE 2

| Conditions | | $B_8$ (T) Lowest temperature site | Highest temperature site | Mean of highest and lowest temperature sites | Temperature differential (°C.) between highest and lowest temperature sites during increase of $N_2$ partial pressure | Notes |
|---|---|---|---|---|---|---|
| (1) | (a) | 1.92 | 1.92 | 1.92 | — | Comparative example |
| | (b) | 1.95 | 1.92 | 1.935 | 149 | Comparative example |
| (2) | (a) | 1.93 | 1.93 | 1.93 | — | Comparative example |
| | (b) | 1.96 | 1.94 | 1.95 | 80 | This invention |
| (3) | (a) | 1.93 | 1.92 | 1.925 | — | Comparative example |
| | (b) | 1.96 | 1.93 | 1.945 | 58 | This invention |

EXAMPLE 3

Hot-rolled sheet 2.3 mm thick containing 3.30% silicon, 0.078% carbon, 0.027% acid-soluble aluminum, 0.0083% nitrogen, 0.075% manganese, 0.026% sulfur, 0.11% tin and 0.06% copper was maintained for thirty seconds at 1120° C. and then for one minute at 900° C., and was then quenched and cold-rolled to a final thickness of 0.225 mm and subjected to decarburization annealing. This was followed by the application of an annealing separating agent having MgO as the main ingredient.

Computer simulation was used to obtain the thermal history of the highest and lowest temperature sites in 5-ton coils heated in a batch-type heating furnace, as follow.

(1) To 1200° C. at 20° C./hr and at 1200° C. for 20 hours.

(2) To 1050° C. at 20° C./hr, annealing at 1050° C. for twenty hours, and heating to 1200° C. at 20° C./hr, and at 1200° C. for 20 hours.

Experiments were then conducted using these thermal history conditions.

Atmospheric gas processing conditions were:

(a) 75% $H_2$+25% $N_2$ up to a lowest temperature site temperature of 1100° C.;

(b) 75% $H_2$+25% $N_2$ lowest temperature site temperature of 970° C. and 10% $H_2$+90% $N_2$ from a lowest temperature site temperature of 970° C. to 1100° C.

Using this two-level processing, annealing was carried out at 100% $H_2$ after the lowest temperature site temperature reached 1100° C. from room temperature.

Whichever the set of conditions, secondary recrystallization was at an intermediate stage at 970° C., and under condition (2) the rate of temperature increase at the highest temperature site did not exceed 13° C./hr at least temporarily during the time the lowest temperature site was at a temperature of from 850° C. to 1100° C. Table 3 shows the processing conditions used and the magnetic flux density of the product.

TABLE 3

| Conditions | | $B_8$ (T) Lowest temperature site | Highest temperature site | Mean of highest and lowest temperature sites | Temperature differential (°C.) between highest and lowest temperature sites during increase of $N_2$ partial pressure | Notes |
|---|---|---|---|---|---|---|
| (1) | (a) | 1.92 | 1.93 | 1.925 | — | Comparative example |
| | (b) | 1.94 | 1.93 | 1.935 | 149 | Comparative example |
| (2) | (a) | 1.93 | 1.92 | 1.925 | — | Comparative example |
| | (b) | 1.96 | 1.93 | 1.945 | 45 | This invention |

EXAMPLE 4

Hot-rolled sheet 2.3 mm thick containing 3.25% silicon, 0.075% carbon, 0.028% acid-soluble aluminum, 0.0082% nitrogen, 0.074% manganese, 0.024% sulfur, 0.12% tin and 0.06% copper was annealed for two minutes at 1100° C., cold-rolled to a final thickness of 0.225 mm and subjected to decarburization annealing by a known method. This was followed by the application of an annealing separating agent having MgO as the main ingredient.

Computer simulation was used to obtain the thermal history of the highest and lowest temperature sites in a central 5-ton portion of a 10-ton coil heated in a batch-type heating furnace, as follows.

(1) To 1200° C. at 20° C./hr and at 1200° C. for 20 hours.

(2) To 800° C. at 20° C./hr, from 800° C. to 1100° C. at 5° C./hr and from 1100° C. to 1200° C. at 20° C./hr, and at 1200° C. for 20 hours.

Experiments were then conducted using these thermal history conditions.

Atmospheric gas processing conditions were:

(a) 75% $H_2$+25% $N_2$ up to a lowest temperature site temperature of 1100° C.;

(b) 75% $H_2$+25% $N_2$ up to a lowest temperature site temperature of 970° C. and 10% $H_2$+90% $N_2$ from the central-portion lowest temperature site temperature of 970° C. to 1100° C.

Calculations were also carried out assuming that a 2.5-ton inner portion of the coil and a 2.5-ton outer portion of the coil were 0.35-mm decarburized sheet having been given a coating of an annealing separating agent. Using this two-level processing, annealing was carried out at 100% $H_2$ after the central-portion lowest temperature site temperature reached 1100° C. from room temperature.

Whichever the set of conditions, secondary recrystallization was at an intermediate stage at 970° C., and under condition (2) the rate of temperature increase at the central-portion highest temperature site did not exceed 13° C./hr at least temporarily during the time the central-portion lowest temperature site was at a temperature of from 850° C. to 1100° C. Table 4 shows the processing conditions used and the magnetic flux density of the product.

TABLE 4

| Conditions | | $B_8$ (T) Central-portion lowest temperature site | Central-portion highest temperature site | Mean of central-portion highest and lowest temperature sites | Temperature differential (°C.) between central-portion highest and lowest temperature sites during increase of $N_2$ partial pressure | Notes |
|---|---|---|---|---|---|---|
| (1) | (a) | 1.91 | 1.92 | 1.915 | — | Comparative example |
| | (b) | 1.94 | 1.92 | 1.93 | 178 | Comparative example |
| (2) | (a) | 1.92 | 1.92 | 1.92 | — | Comparative example |
| | (b) | 1.95 | 1.93 | 1.94 | 62 | This invention |

What is claimed is:

1. A method of manufacturing grain-oriented electrical steel sheet having very high magnetic flux density using an inhibitor having AlN as a main ingredient, comprising: a process of decarburization annealing of sheet cold-rolled to a final thickness and a final finish-annealing process following an application of an annealing separating agent; wherein the final finish-annealing takes place in an annealing atmosphere containing $N_2$ and thereby $N_2$ partial pressure, with the $N_2$ partial pressure in the annealing atmosphere being increased at an intermediate stage between start and completion of secondary recrystallization, and a temperature differential in a coil of the sheet between a highest temperature site and a lowest temperature site is controlled to keep it within 100° C. during changes in annealing atmosphere.

2. The method according to claim 1 wherein in the final finish-annealing the $N_2$ partial pressure in the annealing atmosphere is increased at an intermediate stage between start and completion of secondary recrystallization and the rate of temperature rise at a highest temperature site of the coiled sheet is controlled to keep it no higher than 13° C./hr at least temporarily during a period a lowest temperature site of the coiled sheet is in a temperature zone of from 850° C. to 1100° C.

3. The method according to claim 1 wherein final finish-annealing is carried out at a rate of temperature increase of 10° C./hr up to 1200° C. and in an atmosphere of 75% $H_2$ and 25% $N_2$ up to lowest temperature site temperature of 980° C., 10% $H_2$ and 90% $N_2$ at a lowest temperature site temperature of from 980° C. to 1100° C., and 1005 $H_2$ at a lowest temperature site temperature of over 1100° C.

4. The method according to claim 1 wherein final finish-annealing is processed at a rate of temperature increase of 25° C./hr up to 850° C., 10° C./hr from 850° C. to 1100° C. and 25° C./hr from 1100° C. to 1200° C. and in an atmosphere of 75% $H_2$ and 25% $N_2$ up to a lowest temperature site temperature of 980° C., 10% $H_2$ and 90% $N_2$ at a lowest temperature site temperature of from 980° C. to 1100° C., and 100% $H_2$ at the lowest temperature site temperature of over 1100° C.

5. A method for manufacturing grain-oriented electrical steel sheet having very high magnetic flux density in which AlN is used as the main inhibitor, comprising: hot-rolled sheet consisting, by weight, of 2.5 to 4.0% silicon, 0.03 to 0.10% carbon, 0.010 to 0.065% acid-soluble aluminum, 0.0010 to 0.0150% nitrogen, 0.02 to 0.30% manganese and 0.005 to 0.040% sulfur, with the remainder iron and unavoidable impurities, and after any sheet annealing that may be required; followed by one cold-rolling or two or more cold-rollings separated by intermediate annealings to obtain cold-rolled sheet of a final gauge; decarburization annealing of the cold-rolled sheet; final finish annealing in an annealing atmosphere containing $N_2$ and thereby $N_2$ partial pressure following application of an annealing separating agent; increasing the $N_2$ partial pressure of the annealing atmosphere for the final finish-annealing at an intermediate stage between the start and the finish of secondary recrystallization; and keeping a temperature differential in a coil of the sheet between a highest temperature site and a lowest temperature site of the coil to within 100° C. when the annealing atmosphere is being changed.

* * * * *

UNITED STATES PATENT AND TRADEMARK OFFICE

CERTIFICATE OF CORRECTION

PATENT NO. : 4,888,066

DATED : December 19, 1989

INVENTOR(S) : Y. Yoshitomi, et al.

It is certified that error appears in the above-identified patent and that said Letters Patent is hereby corrected as shown below:

Column 8, line 44, change "follow." to --follows.--.

Column 10, line 58, change "1005 H" to --100% H--.

Signed and Sealed this

Twenty-fifth Day of December, 1990

*Attest:*

HARRY F. MANBECK, JR.

*Attesting Officer*

*Commissioner of Patents and Trademarks*